US005375384A

United States Patent [19]

Wolfson

[11] Patent Number: 5,375,384

[45] Date of Patent: Dec. 27, 1994

[54] HOLDOWN APPARATUS FOR A SHEAR WALL

[76] Inventor: Yehuda Wolfson, 2001 S. Barrington Ave., No. 104, Los Angeles, Calif. 90026

[21] Appl. No.: 7,617

[22] Filed: Jan. 22, 1993

[51] Int. Cl.[5] ..... E04H 12/22

[52] U.S. Cl. ..... 52/295; 52/297; 52/296; 52/698

[58] Field of Search ..... 52/295, 297, 300, 704, 52/707, 713, 367, 480, 476, 301, 698, 296

[56] References Cited

U.S. PATENT DOCUMENTS

| | | | |
|---|---|---|---|
| 967,107 | 8/1910 | Cook et al. . | |
| 2,829,514 | 12/1955 | MacLean . | |
| 2,881,876 | 4/1959 | Williams | 52/295 |
| 3,963,210 | 6/1976 | Macklin | 52/295 X |
| 4,192,118 | 3/1980 | Gilb . | |
| 4,199,908 | 4/1980 | Teeters . | |
| 4,321,776 | 3/1982 | Delight | 52/295 X |
| 4,387,543 | 6/1983 | Tschan et al. . | |
| 4,458,463 | 7/1984 | Behrend . | |
| 4,530,194 | 7/1985 | Linton et al. . | |
| 4,665,672 | 5/1987 | Commins et al. . | |
| 4,744,192 | 5/1988 | Commins . | |
| 4,924,648 | 5/1990 | Gilb et al. . | |
| 4,989,386 | 2/1991 | Collis . | |
| 4,995,206 | 2/1991 | Colonias et al. . | |

FOREIGN PATENT DOCUMENTS

| | | | |
|---|---|---|---|
| 6703671 | 10/1967 | Netherlands | 52/295 |

*Primary Examiner*—Carl D. Friedman
*Assistant Examiner*—Beth A. Aubrey
*Attorney, Agent, or Firm*—King & Schickli

[57] ABSTRACT

A holdown apparatus is provided for securing a shear wall to a concrete base. The apparatus includes an upright tie member and a cooperating anchoring member. The upright tie member has (1) a tubular base, (2) a pair of spaced, upstanding anchoring plates mounted to the base and adapted to received a post, preferably an end post, of the shear wall and (3) a plurality of fasteners for extending through the anchoring plates and the post. The anchoring member includes a plate, a fastener for the upright tie member secured to the plate and a pair of support legs for the plate.

14 Claims, 2 Drawing Sheets

HOLDOWN APPARATUS FOR A SHEAR WALL

TECHNICAL FIELD

The present invention relates generally to the construction field and, more particularly, to an improved, holdown apparatus of high strength for securing a shear wall to a concrete base such as a slab or foundation.

BACKGROUND OF THE INVENTION

Holdowns of various construction for anchoring multiple studs or posts of framed walls to concrete base have long been known in the art. Examples of such holdowns are disclosed in, for example, U.S. Pat. No. 4,199,908 to Teeters; U.S. Pat. No. 4,924,648 to Gilb et al.; and U.S. Pat. No. 4,995,206 to Colonias et al. Each of these holdowns include an anchoring portion that is set in the concrete base and a pair of spaced, upstanding plates provided with a clearance therebetween to receive a wall post or studs. Screws, throughbolts, nails or other fasteners secure the studs/post in position.

In order to meet building code requirements, each of the holdowns also includes a base member for raising the bottom of the studs/post a set distance above the surface of the concrete base. This is to prevent the studs/post from becoming exposed to water that may rest on the concrete base and would, therefore, otherwise wet the studs/post and cause damage over time. Where wood studs/post are utilized, this is a particularly significant concern.

While the various holdowns developed to date function reasonably well, they do suffer two major shortcomings. Specifically, they are difficult to maintain in alignment and plumb when pouring and spreading concrete. They also do not display the desired strength in tension necessary to resist the uplift caused by overturning due to lateral seismic forces resulting from earthquakes. Accordingly, existing quickset holdowns are not generally utilized for earthquake-resisting shear walls.

SUMMARY OF THE INVENTION

Accordingly, it is a primary object of the present invention to provide an improved holdown apparatus of simple and inexpensive construction exhibiting a significant capacity to withstand uplift forces.

Still another object of the present invention is to provide an improved holdown exhibiting the enhanced strength in tension necessary to resist uplifting resulting from lateral seismic forces and thereby allowing successful utilization in securing shear walls to concrete bases.

Yet another object of the present invention is to provide a holdown apparatus for shear walls having a two piece construction that significantly simplifies use. More specifically, the anchoring member of the holdown apparatus may be secured to an underlying form and/or concrete reinforcing steel so as to steadfastly stay in alignment and plumb during the pouring and spreading of concrete. Additionally, the upright tie member allows simple fastening of the shear wall studs/post in double shear, while being centered over the holdown, so as to provide enhanced load bearing capacity.

Additional objects, advantages and other novel features of the invention will be set forth in part in the description that follows and in part will become apparent to those skilled in the art upon examination of the following, or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved holdown apparatus is provided for securing a shear wall to a concrete base. The holdown apparatus includes an upright tie member for securing to the studs/post of a shear wall and a cooperating anchoring member for anchoring the upright tie member and, therefore, the shear wall studs/post to the concrete base.

More specifically, the upright tie member includes a tubular base that is formed by tubular steel of substantially square cross-section. Preferably, the tubular base has dimensions of substantially 6"×6". Additionally, a pair of spaced upstanding anchoring plates are mounted to the tubular base. Sufficient clearance is provided between the plates so as to snugly receive the multiple end studs/post of a shear wall therebetween. Of course, it should be appreciated that the lower end of the studs/post rests upon the upper wall of the tubular base. Accordingly, the studs/post is raised above the concrete base and is therefore protected from wetting by moisture held by or resting upon the concrete.

A plurality of fasteners, such as bolts, may be extended through the upstanding anchoring plates and the interdisposed studs/post of the shear wall. Advantageously, such through bolts act at both faces of the studs/post in double shear to provide excellent uplift capacity.

The anchoring member includes a main plate supported at opposite ends by a pair of legs. Preferably, the legs are L-shaped with the foot end including one or more apertures allowing the legs to be anchored to an underlying wood form. Additionally, the plate and/or legs may be anchored to reinforcing steel laid above the form. This may, for example, be accomplished by means of tie wire that is wrapped around the anchoring member or through the foot apertures thereof and also around the reinforcing steel so as to further hold the anchoring member in position. Advantageously, it should be appreciated that this connecting arrangement insures that the anchoring member maintains it proper position in the form as concrete is poured and spread to for the slab or foundation.

The anchoring member also includes an upstanding or projecting fastener such as a bolt that is fixed to the plate. This projecting fastener extends upwardly from the poured concrete base and is adapted to secure the upright tie member. Advantageously, it should be appreciated that the securing of the anchoring member in position to the underlying form and/or reinforcing steel ensures the holdown apparatus is not only maintained in proper alignment for supporting the shear wall but also is maintained in plumb. Accordingly, full benefit of the load bearing and uplift capacity characteristics of the holdown apparatus may be obtained.

In accordance with an additional aspect of the present invention, the upright tie member includes an aperture in the lower wall of the tubular base through which the projecting fastener of the anchoring member is extended. As an aid in further securing the upright tie member in position, a raised platform may also be provided. Specifically, the raised platform is substantially n-shaped in section and mounted inside the tubular base. Advantageously, the upper wall of the raised platform also includes an aperture for receiving the projecting fastener of the anchoring member. Thus, it should be appreciated that the fastener is extended through two pieces of thick steel plate to provide strong, two point engagement. A nut may be tightened down on the threaded fastener into engagement with the raised platform to complete the securing process. Of course, the two-point engagement of the fastener with the upright tie member simplifies installation as the shear wall is effectively held from tilting over until the bolt may be tightened down.

Of course, it should be appreciated that building code requirements and load bearing needs vary from application to application. The uplift capacity of the holdown apparatus of the present invention, may be readily adjusted to meet these requirements by: (1) increasing or reducing the surface area of the main plate that is imbedded in the concrete; and/or (2) extending the length of the pair of spaced upstanding anchoring plates and increasing the number or diametrical dimension of the bolts connecting the anchoring plates to the multiple end studs/post of the shear wall.

In like manner, the downward force or load bearing characteristics of the holdown apparatus 10 may be increased by increasing the thickness of the steel used in the tubular base. Accordingly, it should be appreciated that the two holdown apparatus 10 at opposite ends of a shear wall function in cooperation to effectively provide enhanced uplift and down force capacity producing a coupled effect that better resists over-turning.

Still other objects of the present invention will become apparent to those skilled in this art the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Figure 1:
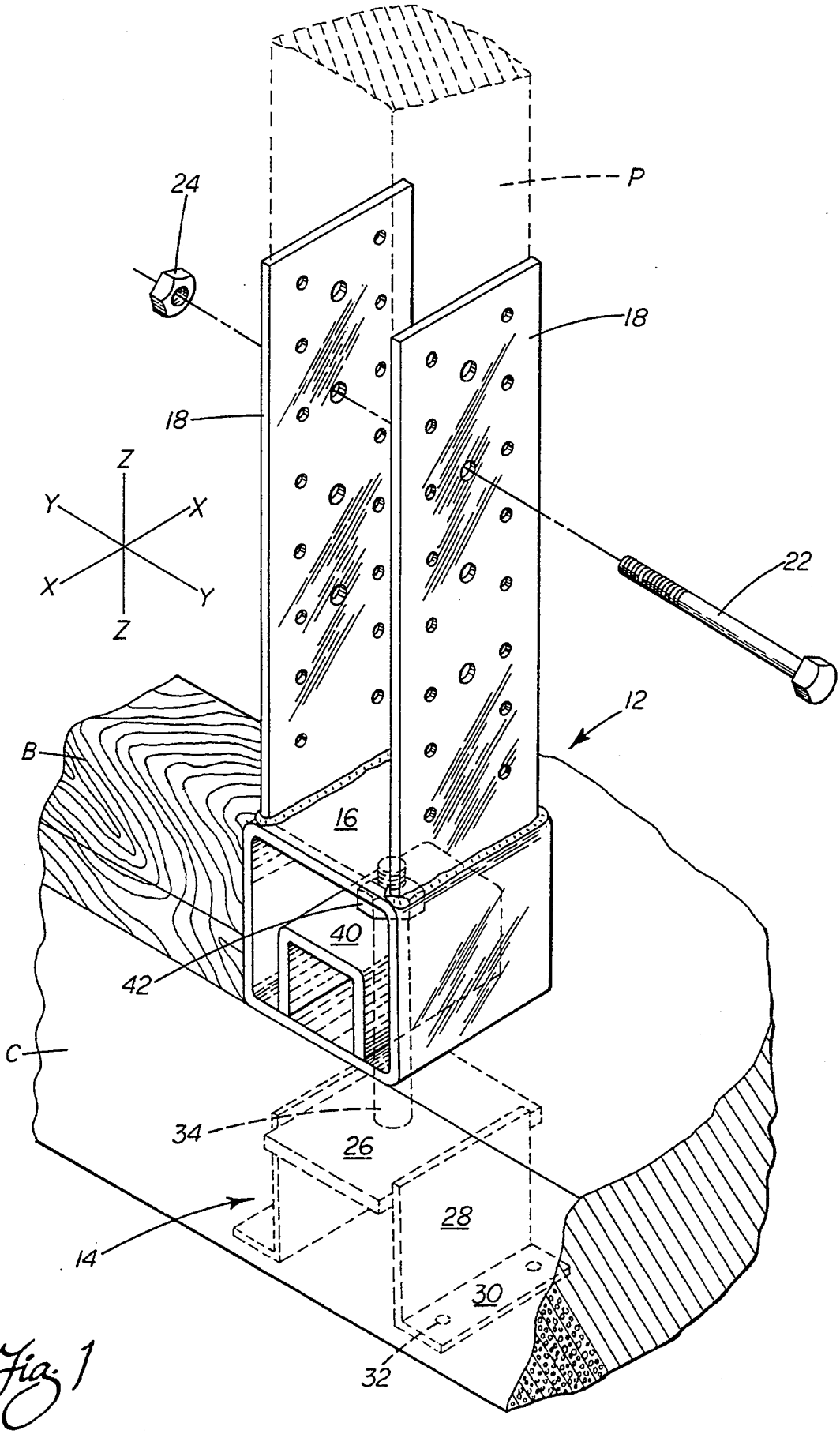
FIG. 1 is a detailed perspective view showing the holdown apparatus 10 of the present invention for securing multiple end studs/post of a shear wall to a concrete base such as a slab or foundation.

Reference will now be made in detail to the present preferred embodiment of the invention, an example of which is illustrated in the accompanying drawing.

DETAILED DESCRIPTION OF THE PREFERRED EMBODIMENT

Reference is now made to the drawing figures showing the improved holdown apparatus 10 of the present invention. As particularly shown in overview in FIG. 3, the holdown apparatus 10 is utilized to secure a shear wall W to a concrete slab C. As shown, the shear wall W is framed from a series of studs S of wood or metal. Preferably, a holdown apparatus 10 is connected to the multiple studs or post P at each end of a shear wall (only one shown in FIG. 3). The resulting maximum spacing between the two opposing holdown apparatus 10 minimizes the uplift, or pullout force caused by overturning due to lateral forces produced by earthquakes.

Figure 2:
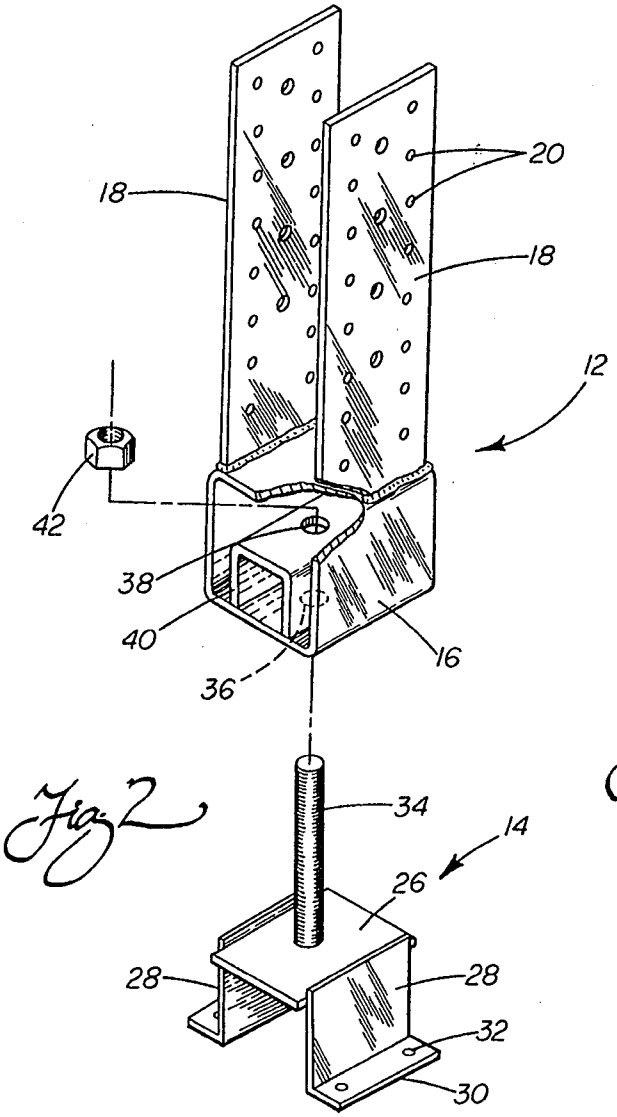
FIG. 2 is a partially sectional exploded perspective view of the apparatus of FIG. 1.

As best shown in FIGS. 1 and 2, the holdown apparatus 10 includes two subassemblies, an upright tie member 12 and an anchoring member 14. As different subcontractors generally perform the concrete work and the framing work and the anchoring member 14 must be set in the concrete while the upright tie member 12 must be connected to the framing (e.g. post P of the shear wall W), this is an important aspect of the invention. Specifically, the two piece construction corresponds with the delegation of duty between the subcontractors so as to allow more efficient performance of those duties.

The upright tie member 12 includes a tubular base 16. Preferably, the tubular base 16 is formed from ½" thick tubular steel having a substantially square cross-section. Such a base may, for example, have a cross sectional dimension of 6"×6". The tubular base 16 may be of any desired length (as shown in the X direction in FIG. 1) as determined by the size of the studs/post P which is to be connected thereto and supported thereon. Advantageously, the tubular base 16 provides substantial strength to the holdown apparatus 10 particularly in compression but also in tension. This is a characteristic that significantly enhances the performance of the holdown 10 of the present invention in resisting overturning of the shear wall and earthquake damage resulting therefrom.

A pair of spaced, upstanding anchoring plates 18 (e.g. ¼" thick steel plates) are welded to the upper surface of the tubular base 16. The relative spacing between the plates 18 may be varied to match and just provide sufficient clearance to receive the studs/post P to be secured to the holdown apparatus 10. Of course, the relative width of the plates 18 may also be adjusted in accordance with the underlying tubular base 16 to correspond to and match the width dimension of the studs/post P (as shown in the Y direction in FIG. 1). Additionally, it should be appreciated that depending upon the required strength of the holdown apparatus 10, the relative length, that is, the height of the projection of the plates above the tubular base (the longitudinal axis as shown in the Z direction in FIG. 1), may be adjusted to provide additional points for securing to the studs/post P.

Figure 3:
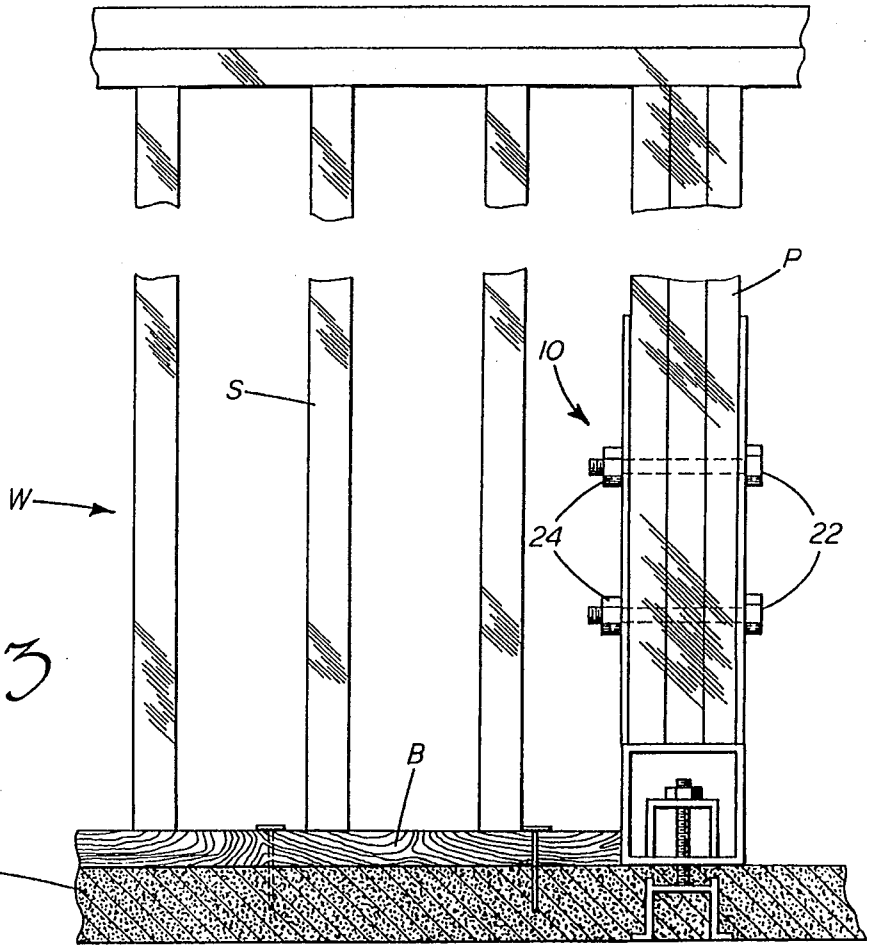
FIG. 3 is a partially sectional side elevational view showing the relative positioning of the apparatus 10 of the present invention relative to a shear wall.

As shown in FIGS. 1–3, the plates 18 include a series of apertures 20 therein. Fasteners such as screws, nails and/or bolts may be extended through the openings 20 in the plates 18 to engage in the studs/post P as required to complete the connection. Of course, where bolts 22 are utilized as shown in FIGS. 1 and 3, matching throughholes are drilled through the studs/post P. This allows the bolts 22 to be extended through both plates 18 and the studs/post P. The connection is then completed by tightening down a matching nut 24 on each bolt 22. Advantageously, as bolts 22 installed in this manner act at both faces of the studs/post P, the bolts are effectively acting in double shear so as to maximize their holding capacity and load transfer.

The anchoring member 14 includes a main plate 26. Preferably, the plate 26 is formed from ½" thick plate steel. The length and width dimensions of the plate 26 may be varied depending upon the required uplift capacity for a particular application. The larger the surface area of the plate as defined by the length and width dimensions, the greater the uplift capacity. For example, uplift capacity of up to at least 31,000 pounds may be provided through utilization of a main plate having dimensions of 3.5"×3.5" and utilizing spaced upstanding anchoring plates of 22.0" length with four bolts of 0.875" diameter.

A pair of opposed legs 28 support the plate 26. Specifically, the legs 28 are L-shaped so as to include feet 30. Together, the legs 28 and feet 30 provide a relatively wide, stable stance that prevent the anchoring member 14 from tipping over during the pouring of the concrete base C. Further, it should be appreciated that the feet 30 include two or more apertures 32. When setting an anchoring member 14 in position, nails may be driven through the apertures 32 to secure the anchoring member 14 to an underlying plywood form. In this way it is possible to hold the anchoring member 14 in absolute alignment and plumb. Similarly, the legs 28 or the bolt 34 may be utilized in conjunction with tie wire to secure the anchoring member 14 in position on or between concrete reinforcing steel known as rebars.

Whether these two approaches are utilized singularly or in combination, the positioning and alignment of the anchoring member 14 is properly maintained during the pouring and setting of the concrete. This is a particularly important aspect of the present invention as an anchoring member 14 out of alignment and plumb is effectively useless. In fact, the maintaining of positioning and alignment of anchoring members when pouring and spreading concrete has been a major problem contributing to the unsatisfactory results achieved utilizing holdown apparatus of the prior art.

As should be further appreciated, an upright or projecting fastener 34 (e.g. steel bolt of one inch diameter) is fixed to the main plate 26 of the anchoring member 14. As with the legs 28, the fastener 34 may also be welded in position. When properly positioned in the concrete base C, the fastener 34 is the only part of the anchoring member 14 that is exposed, extending upwardly from the concrete base C.

The upright tie member 12, described above, is connected to the fastener 34. Accordingly, the critical need to maintain the anchoring member 14 and, therefore, the projecting fastener 34 in proper plumb and alignment described above should be appreciated. Specifically, connection is made by positioning the upright tie member 12 over the fastener 34 so as to thread the fastener through the aperture 36 in the bottom wall of the tubular base 16 and the aperture 38 in the substantially n-shaped raised platform 40. The raised platform 40 is also constructed from heavy steel and welded to the interior of the tubular base 16 to reinforce that wall against buckling due to compression (down load). Advantageously, it should also be appreciated that two-point contact is provided by the fastener 34 in the apertures 36, 38 in the lower wall of the tubular base and raised platform, respectively. This enhances the structural integrity of the connection and, accordingly, the holdown apparatus 10. A nut 42 is threaded to the fastener 34 and tightened down to the raised platform 40 to secure the two subassemblies 12, 14 together.

The utilization of the holdown apparatus 10 will now be described in detail. Specifically, for simplicity, the installation of a relatively short, prefabricated shear wall W will be described. Of course, it should be appreciated that the invention is equally applicable for use with shear walls constructed on-site.

After preparing a form for the concrete base C that includes a plywood bottom wall or floor, the proper positioning of the shear wall W and particularly, the holdown apparatus 10 for securing the ends of the shear wall is determined. An appropriately sized anchoring member 14 is then placed on the plywood form floor as required. The anchoring member 14 is then secured in position by driving one or more nails through apertures 32 in each of the opposed feet 30 of the anchoring member 14 into the underlying plywood. The fastener 34 is then checked to confirm that it is plumb. If not, appropriate adjustments are made utilizing, for example, wood wedges under the feet 30, as required. This procedure is then repeated to secure the anchoring member 14 for the opposite end of the shear wall W.

More specifically, the holdown apparatus 10 are capable of sustaining both compression due to a downward load and tension due to an upward load (uplift). Thus, the apparatus are placed concentric with and vertically aligned under the shear wall end members (studs/posts P). In this way, the distance between the opposing apparatus, and therefore their operating efficiency, are maximized.

After positioning the two anchoring members 14 in the manner described and adding the necessary reinforcing steel in the form, the concrete base C is poured. During the pouring and spreading of the concrete, the nails fastening the anchoring members 14 to the underlying plywood fully ensure that the anchoring members remain in proper position and alignment. After the concrete sets, the two fasteners 34 for securing the shear wall W extend upwardly in plumb alignment above the concrete base C to allow the quick and efficient completion of the installation by the framing subcontractor.

Specifically, the framing subcontractor first positions an upright tie member 12 on the multiple end studs/post P at each end of the shear wall. Specifically, the upright tie member 12 when fully seated has the lower end of the post P engaging the upper surface of the tubular base 16 with the upstanding plates 18 engaging opposed sidewalls of the studs/post P. Additionally, .one of the side faces of the tubular base 16 substantially abuts the bottom or sill plate B of the shear wall W. The connection may be completed, as described above, by driving nails, or screws through the apertures 20 in the plates 18 into the interdisposed studs/post P. Alteratively, as shown in the figures, aligned holes may be drilled through the studs/post P. Bolts 22 may then be extended through the aligned holes 20 in the plates 18 and the holes drilled in the studs/post P. Nuts 24 may then be tightened down on the bolts 22 to secure the post P in position over the center of the tubular base 16.

After securing an upright tie member 12 to each end studs/post P of the shear wall W, the shear wall W may be raised as a unit and placed in position on the concrete base C. More specifically, the apertures 36, 38 in the tubular base 16 and raised platform 40, respectively, of each upright tie member 12 are aligned with the cooperating fastener 34. The shear wall W is then lowered until the bottom face of each tubular base 16 and the sill plate B engage the concrete base C. Nuts 42 are then tightened down on the fasteners 34 until seated against the raised platform 40. A ramset may then be utilized to drive nails through the sill plate B into the underlying concrete base C and further secure the shear wall W in position.

In summary, numerous benefits have been described which result from employing the concepts of the present invention. Advantageously, the holdown apparatus includes a two piece construction that is particularly adapted for utilization in today's work environment wherein different subcontractors generally complete the concrete and framing work. Additionally, the anchoring member 14 of the apparatus 10 includes a particularly stable "platform" that may be secured in position to maintain alignment and plumbness as concrete is poured and spread. Further, the upright tie member 12 and anchoring member 14 function together to provide significantly enhanced strength, particularly intended to resist overturning as a result of seismic forces.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

I claim:

1. A holdown apparatus for securing a shear wall to a concrete base, comprising:

an upright tie member for securing to said shear wall and a cooperating anchoring member for anchoring said upright tie member to said concrete base, said anchoring member being set in said concrete of said concrete base;

said upright tie member including (1) a tubular base, (2) a pair of spaced upstanding anchoring plates mounted to said tubular base providing sufficient clearance to receive a post of said shear wall therebetween and (3) a plurality of fasteners for extending through said upstanding anchoring plates and an interdisposed post of said shear wall; and said anchoring member including (1) a plate, (2) a fastener for said upright tie member secured to said plate and (3) a pair of support legs for said plate.

2. The apparatus set forth in claim 1, wherein said upright tie member includes a raised platform for securing said upright tie member to said anchoring member.

3. The apparatus set forth in claim 2, wherein said raised platform is substantially n-shaped in section and mounted in said tubular base.

4. The apparatus set forth in claim 1, wherein said tubular base has a substantially square cross-section.

5. The apparatus set forth in claim 4, wherein said tubular base has dimensions of substantially 6"×6".

6. The apparatus set forth in claim 1, wherein said anchoring member extends in a substantially horizontal plane.

7. The apparatus set forth in claim 6, wherein said plate has a thickness of at least ½" and a width and length dimension of at least 3.0" and 3.0" respectively.

8. The apparatus set forth in claim 7, wherein said legs of said anchoring member are L-shaped.

9. A holdown apparatus for securing a shear wall to a concrete base, comprising:

an upright tie member for securing to said shear wall and a separate cooperating anchoring member for anchoring said upright tie said concrete of said concrete base;

said upright tie member including (1) a base, (2) a pair of spaced upstanding anchoring plates mounted to said base providing sufficient clearance to receive a post of said shear wall therebetween, said upstanding anchoring plate having a longitudinal axis extending upwardly from said base, and (3) a plurality of fasteners for extending through said upstanding anchoring plates and into an interdisposed post of said shear wall; and said anchoring member including (1) a plate and (2) a fastener for said upright tie member secured to said plate.

10. The apparatus set forth in claim 9, wherein said upright tie member includes a platform that is substantially n-shaped in section and mounted to said base for securing said upright tie member to said anchoring member.

11. The apparatus set forth in claim 9, wherein said anchoring member extends in a substantially horizontal plane.

12. The apparatus set forth in claim 11, wherein said plate has a thickness of at least ½" and a width and length dimension of at least 3.0" and 3.0" respectively.

13. A holdown apparatus for securing a shear wall to a concrete tubular base, comprising:

an upright tie member for securing to said shear wall and a cooperating anchoring member for anchoring said upright tie member to said concrete base, said anchoring member being set in said concrete of said concrete base;

said upright tie member including (1) a tubular base, (2) a pair of spaced upstanding anchoring plates mounted to said tubular base providing sufficient clearance to receive a post of said shear wall therebetween and (3) a plurality of fasteners for extending through said upstanding anchoring plates and into an interdisposed post of said shear wall; and said anchoring member including (1) a plate and (2) a fastener for said upright tie member secured to said plate.

14. The apparatus set forth in claim 13, wherein said tubular base has a substantially square cross-section.

* * * * *

UNITED STATES PATENT AND TRADEMARK OFFICE

CERTIFICATE OF CORRECTION

PATENT NO. : 5,375,384

DATED : December 27, 1994

INVENTOR(S) : Yehuda Wolfson

It is certified that error appears in the above-indentified patent and that said Letters Patent is hereby corrected as shown below:

On the title page item [76], change "No. 104" to --No. 114-- and change the zip code from "90026" to --90025--.

In the Abstract, line 6, change "received" to --receive--.

In Column 2, line 49, change "for" to --form--.

In Claim 9, line 17, following "tie", insert --member to--; line 23, change "plate" to --plates--.

Signed and Sealed this

Twenty-fifth Day of April, 1995

Bruce Lehman

*Attest:*

BRUCE LEHMAN

*Attesting Officer*

*Commissioner of Patents and Trademarks*